United States Patent [19]

Harwood et al.

[11] Patent Number: 4,537,027

[45] Date of Patent: Aug. 27, 1985

[54] HYBRID EXHAUST MANIFOLD

[75] Inventors: Jon W. Harwood; Michael W. Clegg; Mark C. Treadwell, all of Toledo, Ohio

[73] Assignee: APX Group, Inc., Toledo, Ohio

[21] Appl. No.: 554,127

[22] Filed: Nov. 21, 1983

[51] Int. Cl.[3] ..... F01N 7/10

[52] U.S. Cl. ..... 60/323; 29/157 R; 29/428; 29/463

[58] Field of Search ..... 60/282, 323; 29/157 R, 29/428, 463

[56] References Cited

U.S. PATENT DOCUMENTS

| | | | |
|---|---|---|---|
| 3,703,083 | 11/1972 | Tadokoro | 60/323 |
| 3,940,927 | 3/1976 | Maurhoff | 60/323 |
| 4,215,093 | 7/1980 | Yasuda | 29/157 R |

FOREIGN PATENT DOCUMENTS

| | | | |
|---|---|---|---|
| 1286368 | 1/1962 | France | 60/323 |

*Primary Examiner*—Douglas Hart

*Attorney, Agent, or Firm*—Anthony J. Casella; Gerald E. Hespos

[57] ABSTRACT

A hybrid exhaust manifold is provided for use with a vehicular engine. The manifold includes an inlet flange formed from a metal plate to be mounted against the engine cylinder head. The inlet flange includes exhaust ports which align with the exhaust ports of the engine cylinder head. Inner and outer stamped sheet metal shells are provided to mate with one another for forming an enclosed exhaust chamber. The inner shell includes inlet apertures which align respectively with the exhaust ports of the inlet flange. The outer shell includes an outlet aperture. An outlet tube is affixed to the outlet aperture of the outer shell, and an outlet flange is affixed to the end of the outlet tube opposite the outer shell to facilitate connection of the outlet tube to the exhaust pipe. The subject hybrid exhaust manifold can be adapted to fit within a very small space envelope in the engine compartment.

14 Claims, 5 Drawing Figures

HYBRID EXHAUST MANIFOLD

BACKGROUND OF THE INVENTION

The exhaust manifold of a vehicular engine connects several exhaust ports of the engine to an exhaust pipe. The exhaust pipe then extends from the engine compartment to a muffler and tail pipe assembly. Exhaust gases generated by combustion in the engine are directed sequentially through the exhaust manifold, the exhaust pipe, the muffler and the tail pipe, and ultimately are released into the ambient surroundings. Certain engines, such as V-8's, for example, utilize a pair of exhaust manifolds. In these instances the vehicle may have two separate exhaust systems, or, alternatively the two exhaust pipes may be joined at some point intermediate the engine and the tail pipe.

One type of prior art exhaust manifold utilizes tubes to carry exhaust gases from the respective cylinders. This tubular manifold includes an inlet flange which is mounted directly on the engine cylinder head adjacent the cylinders. The inlet flange has a plurality of spaced apertures corresponding to the exhaust ports of the engine. The tubes are connected to the inlet flange, and are welded to one another so as to eventually connect into a single exhaust pipe. Although tubular exhaust manifolds generally perform well, the tubes often require complex welds and bends. These complexities are especially significant on small engines or on larger engines housed in engine compartments having a small available space envelope. For example, the presence of pollution control equipment, vehicular accessories and such may require the exhaust manifold to connect the engine exhaust ports to the exhaust pipe within a space of between two and three inches.

To fit a tubular exhaust manifold into a small engine compartment it frequently is necessary to make many precise miter cuts to the tubes, and then to subsequently weld the tubes together along the precise miter cuts. The angularly aligned welds are not well adapted for automation, and are generally carried out manually. As a result, the welding of tubular exhaust manifolds is slow and costly. Additionally, as the number and complexity of welds increases, the probability of weld defects also increases. Consequently, an extensive product checking and quality control program must be undertaken with tubular exhaust manifolds which are constructed to occupy a small space.

Another prior art exhaust manifold defines a one piece cast metal tank which includes at least one inlet and an outlet. The inlets are positioned to receive exhaust gases generated by combustion in the cylinders. The outlet is located to connect to the exhaust pipe. Cast metal manifolds efficiently transport gases and can be adapted to many sizes. However, the cast metal exhaust manifold typically weighs about twice as much as a tubular manifold for the same engine. This added weight of course affects fuel efficiency. Additionally the extra front end weight has a detrimental effect on the performance and handling of front wheel drive cars. Furthermore, it is now known that the large mass of the cast metal exhaust manifold adjacent to the engine exhaust ports acts as a heat sink and absorbs the heat of combustion. As a result, the catalytic converter lights-off more slowly and the level of harmful exhaust emitted by the vehicle increases. In certain instances, the use of a cast metal manifold necessitates the use of additional pollution control equipment such as air pumps.

In view of the above, it is an object of the subject invention to provide an exhaust manifold which is both light weight and easy to manufacture.

It is another object of the subject invention to provide an exhaust manifold which can be manufactured easily to fit in small spaces.

It is an additional object of the subject invention to provide an exhaust manifold which eliminates complex welding and bending of tubes.

It is a further object of the subject invention to provide an exhaust manifold with a configuration that is conducive to automated welding.

It is another object of the subject invention to provide an exhaust manifold which enables pollution control equipment to operate most efficiently.

SUMMARY OF THE INVENTION

The exhaust manifold of the subject invention is a hybrid structure comprising an inlet flange, a stamped sheet metal inner and outer shell combination which defines a manifold enclosure or exhaust chamber for mounting on the inlet flange, and an outlet tube formed from tubing bent into a desired configuration for a particular application. The inlet flange typically is a plate metal, such as steel. The flange is provided with mounting holes which are alignable with holes in the engine cylinder head, and exhaust ports which are positioned to be aligned with the exhaust ports of the engine cylinder head. Thus, when the inlet flange is mounted adjacent the engine cylinder head with its mounting holes aligned with appropriate holes in the engine cylinder head, the exhaust ports in the inlet flange are generally in register with the exhaust ports of the engine cylinder head. As explained further below, the perimeter of the exhaust ports on the surface of the inlet flange opposite the engine block are chamfered to an angle of approximately 45°. In certain embodiments the inlet flange may be formed from stamped sheet metal.

A stamped sheet metal inner shell is formed to fit adjacent the inlet flange. More particularly the inner shell is formed to include a plurality of inlet apertures which are positioned to be in register with and adjacent the exhaust ports of the inlet flange. Each inlet aperture includes a mounting flange which is located and dimensioned to extend into the respective exhaust ports of the inlet flange. As the subject hybrid exhaust manifold is assembled, the mounting flange of the inner shell is welded to the inlet flange adjacent the exhaust ports therein. The configuration of the inner shell further provides access to the mounting holes in the inlet flange so that the assembled hybrid exhaust manifold can be bolted onto the engine cylinder head.

The outer shell of the hybrid exhaust manifold of the subject invention also is formed from stamped sheet metal, and is configured to be mounted adjacent the inner shell. More particularly, the outer shell is configured to define an exhaust chamber or plenum when joined to the inner shell. It is preferred that the outer and inner shells be joined along a seam which is configured to facilitate automated welding of the two stamped sheet metal members. For example, the perimeter of the inner shell may be substantially planar, with the perimeter of the outer shell defining a substantially planar lip which abuts against the perimeter of the inner shell. Thus the seam between the inner and outer shells lies essentially in a common plane and can be seam welded easily. Alternatively the perimeter of the inner shell may define an upwardly extending peripheral flange, and the outer shell may be configured to fit closely within this peripheral flange. Again, with this embodiment the weld between the inner and outer shells can be readily accomplished. The outer shell further includes a stamp formed outlet which preferably includes an outwardly extending tube mounting flange. The location of the outlet is determined by the space requirements of the engine compartment. The tube mounting flange of the outlet is dimensioned to telescopingly engage an outlet tube as explained below. The outlet tube may either be slid over or within the tube mounting flange of the outer shell.

The outlet tube, as noted above, is dimensioned to telescopingly engage the tube mounting flange of the outlet in the outer shell. The tube is formed from a stainless steel or other suitable metal which is bent to join with the exhaust pipe. Preferably the outlet tube may be welded to the tube mounting flange of the outer shell about the entire perimeter of their connection. The opposed end of the outlet tube may be welded to an outlet flange which facilitates the connection of the subject hybrid exhaust manifold to the exhaust pipe. The outlet flange includes a plurality of mounting apertures which facilitate the interconnection of the subject hybrid exhaust manifold and the exhaust pipe of the vehicle.

The combination of the metal plate inlet flange, the stamped sheet metal inner and outer shell combination and the outlet tube enables the subject hybrid exhaust manifold to be formed into virtually any engine compartment space envelope. Additionally, the hybrid exhaust manifold is light weight, and inexpensive to manufacture and assemble.

DETAILED DESCRIPTION OF THE PREFERRED EMBODIMENTS

Figure 1:
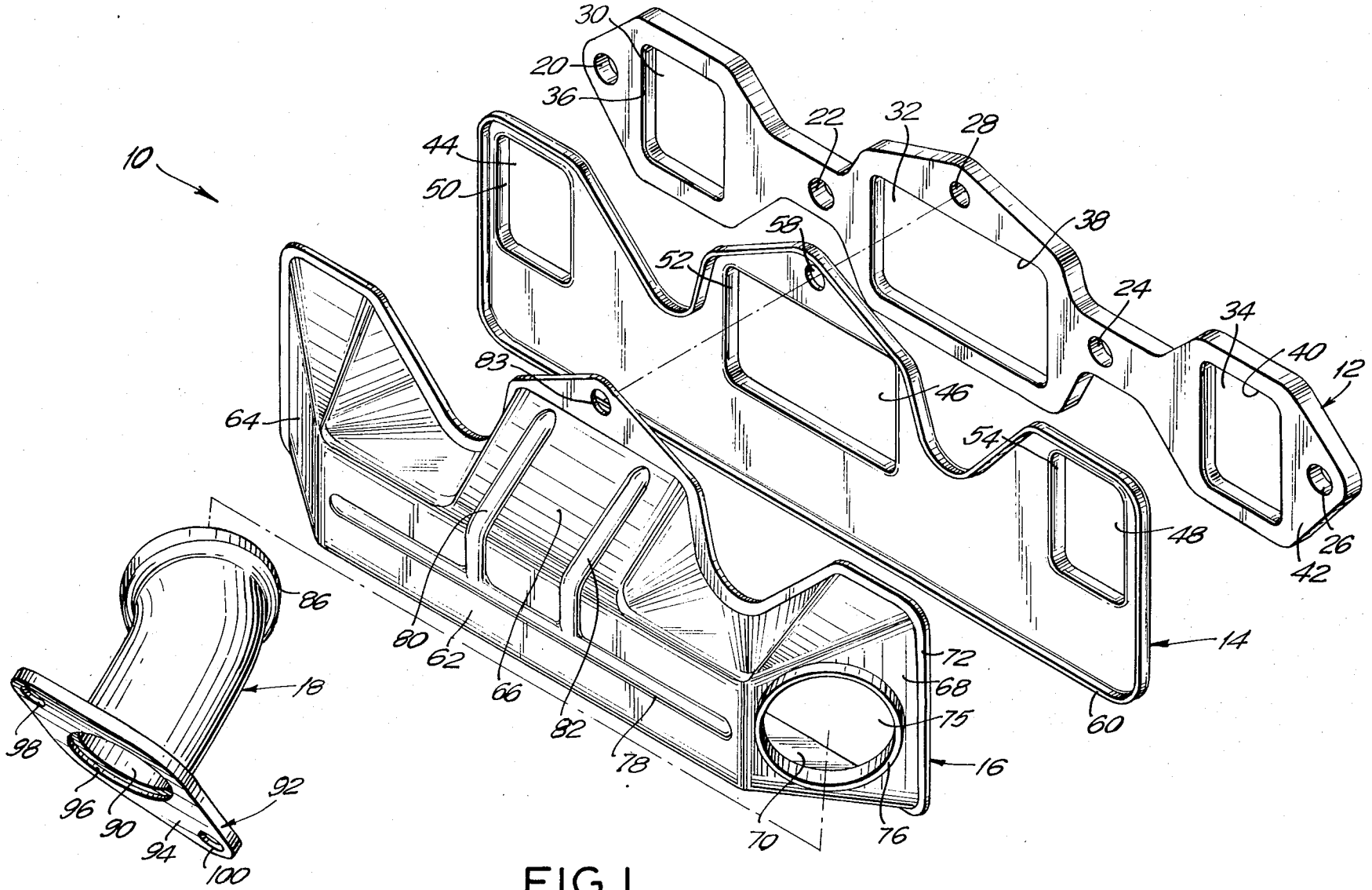
FIG. 1 is an exploded perspective view of the hybrid exhaust manifold of the subject invention.

The hybrid exhaust manifold of the subject invention is indicated generally by the numeral 10 in FIG. 1. Hybrid exhaust manifold 10 is adapted for use with four cylinders of an eight cylinder "V-8" engine, but of course, other embodiments can be manufactured for use with other engine configurations.

As shown most clearly in FIG. 1, the hybrid exhaust manifold 10 includes an inlet flange 12, an inner shell 14, an outer shell 16 and an outlet tube 18. The inlet flange 12 is formed from a plate of SAE 1008-1010 steel having a thickness of at least 6.35 mm. The surface of inlet flange 12 is machined to be flat within 0.15 mm. More particularly, the inlet flange 12 includes generally circular mounting apertures 20, 22, 24, 26 and 28 which are dimensioned to accept bolts (not shown) which extend into threaded apertures in the engine cylinder head to securely mount the inlet flange 12. Inlet flange 12 further includes exhaust ports 30, 32 and 34 which are dimensioned and located to be generally in register with the exhaust ports of the engine cylinder head. Exhaust ports 30 and 34 will be generally in register with the cylinders on opposed ends of one-half of the V-8 engine block. The exhaust port 32 is positioned and dimensioned to be generally in register with the two intermediate cylinders. In alternate embodiments a separate exhaust port could be provided for each cylinder. Preferably the exhaust ports 30, 32 and 34 are partly defined by chamfered edges 36, 38 and 40 respectively adjacent the surface 42 of inlet flange 12 most distant from the engine block. The chamfered edges 36, 38 and 40 preferably are aligned with surface 42 at an angle of approximately 45°, and facilitate the mounting of the inner shell 14 as explained further below.

Figure 2:
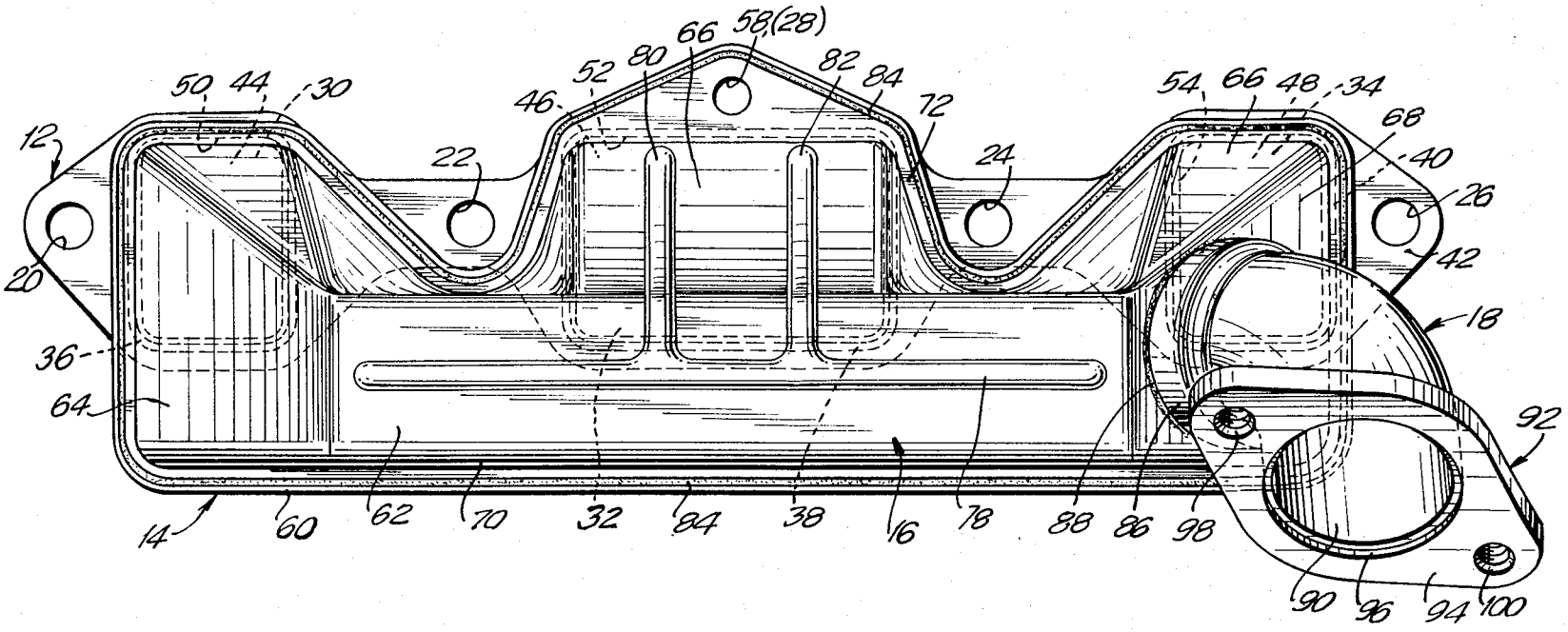
FIG. 2 is a front view of the hybrid exhaust manifold shown in FIG. 1.
Figure 3:
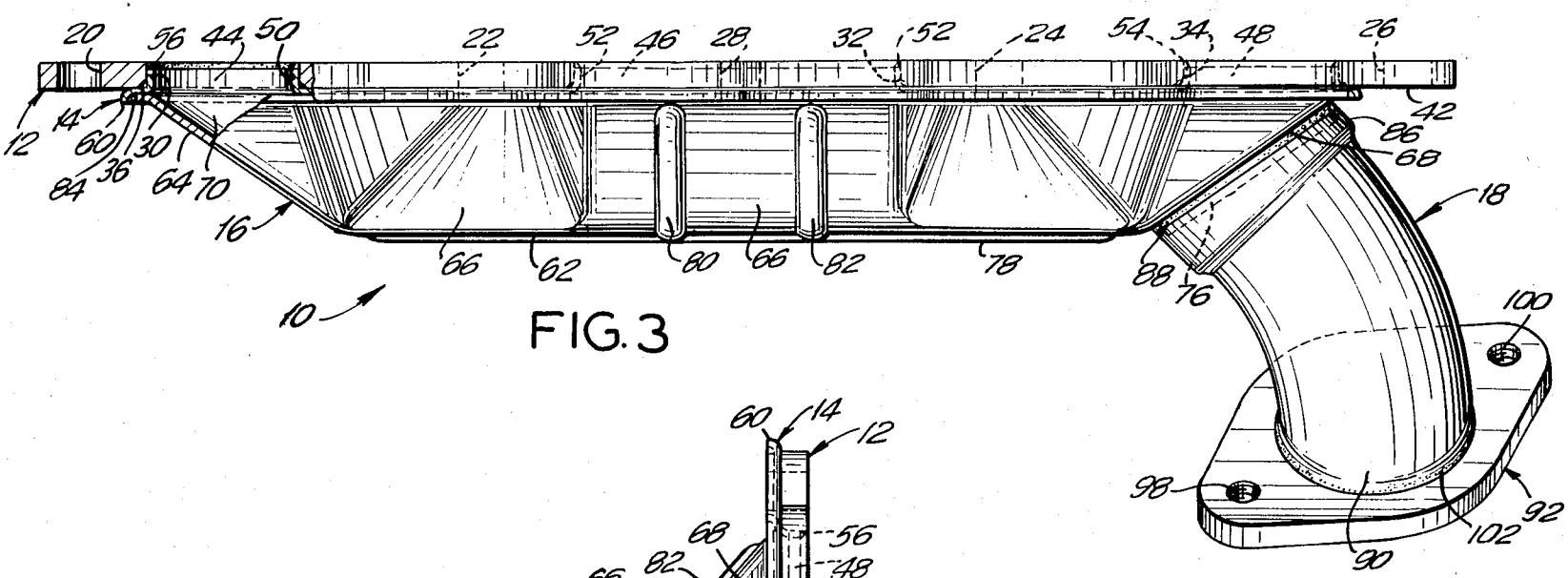
FIG. 3 is a top view of the hybrid exhaust manifold of the subject invention shown partly in section.
Figure 4:
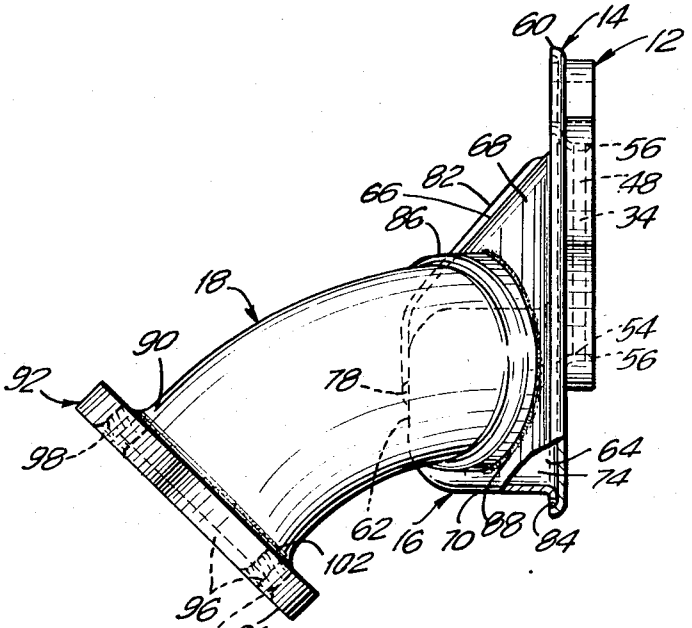
FIG. 4 is a side view of the hybrid exhaust manifold of FIG. 3 shown partly in section.

The inner shell 14 is a generally planar stamped sheet metal member configured to fit in face-to-face contact with the inlet flange 12 without inhibiting access to the mounting holes 20 through 26, as shown most clearly in FIG. 2. The inner shell 14 is provided with inlet apertures 44, 46 and 48 which are located and dimensioned to be in register with the exhaust ports 30, 32 and 34 respectively of the inlet flange 12. More particularly the inlet apertures 44, 46 and 48 are the same size and configuration as the exhaust ports 30, 32 and 34 respectively. Additionally, the inlet apertures 44, 46 and 48 are provided respectively with mounting flanges 50, 52 and 54 which extend normal to the plane of inner shell 14 and are dimensioned to extend into exhaust ports 30, 32 and 34 respectively. As shown most clearly in FIGS. 3 and 4, the mounting flanges 50 through 54 are dimensioned to telescopingly engage and fit closely against the walls of the exhaust ports 30 through 34 respectively, and to extend less than the entire distance through the inlet flange 12. On the assembled hybrid exhaust manifold 10, the inner shell 14 is fixedly joined to the inlet flange 12 by welds 56. The inner shell 14 further is provided with mounting hole 58 which is aligned with the mounting hole 28 in the inlet flange 12. The mounting hole 58 facilitates alignment of the inner shell 14 with the inlet flange 12, and provides an enhanced mounting of the hybrid exhaust manifold 10 to the engine cylinder head. The embodiments of the hybrid exhaust manifold 10 shown in FIGS. 1 through 4 also include a peripheral flange 60 which extends in a direction opposite the mounting flanges 50 through 54 and normal to the plane of inner shell 14. The peripheral flange 60 facilitates the proper positioning of the inner and outer shells 14 and 16 with respect to one another. Both the peripheral flange 60 and the various mounting flanges 50 through 54 are stamp formed into the sheet metal inner shell 14.

The outer shell 16 is a sheet metal member which is stamp formed to include a top wall 62, generally upstanding side walls 64, 66, 68 and 70 and a peripheral flange 72. More particularly, the outer shell 16 is configured to fit adjacent the inner shell 14 such that the combined inner and outer shells 14 and 16 form an exhaust chamber identified by numeral 74 in FIG. 4. Returning to FIGS. 1–3, the outer shell 16 has an outlet aperture 75 which is defined in part by an outlet tube mounting flange 76. Thus the exhaust chamber 74 defined by the inner and outer shells 14 and 16 has inlet apertures 44 through 48 for receiving exhaust gases from the engine and outlet aperture 75 for removing exhaust gases. The top wall 62 and the side wall 66 include stiffening ribs 78, 80 and 82 which are formed into the sheet metal from which the outer shell 16 is formed. The ribs 78–82 provide rigidity and minimize the effects of engine vibrations. The side wall 66 also is configured to provide access to the mounting holes 22 and 24, and includes aperture 83 for mounting the outer shell 16. As shown more clearly in FIGS. 2 through 4, the peripheral flange 72 of the outer shell 16 is configured to fit within the area defined by the peripheral flange 60 of the inner shell 14. On the combined structure a continuous weld 84 extends around the juncture between the inner and outer shells 14 and 16.

Figure 5:
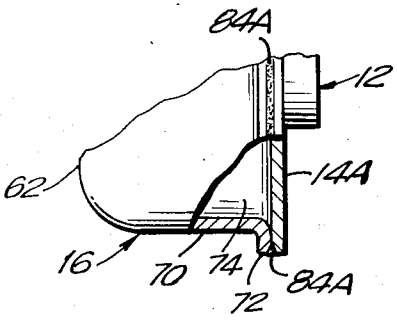
FIG. 5 is a cross-sectional view of an alternate embodiment of the subject hybrid exhaust manifold.

In an alternate embodiment, as shown in FIG. 5, the inner shell 14A has a planar perimeter which abuts directly against the outer shell 16. As explained above, a weld 84A extends continuously around the periphery of the inner and outer shells 14A and 16. In both embodiments, the welds 84 and 84A respectively lie essentially in a single plane and are easily accessible. Furthermore, in view of this planar alignment, the welds 84 and 84A can be carried out quickly and easily and are well suited for automation.

Outlet tube 18 is formed from stainless steel tubing and includes a flared end 86 which is adapted to be telescopingly mounted over the mounting flange 76 of the outlet aperture 75. As shown most clearly in FIG. 3, the outlet tube 18 is attached to the outer shell 16 by weld 88. Mounted at the opposed end 90 of the outlet tube 18 is the outlet flange 92. The outlet flange 92 is formed from a steel plate having a thickness of approximately equal to that of the inlet flange 12. Additionally, surface 94 of the outlet flange 92 is machined to be flat within 0.15 mm to ensure a proper mating with a corresponding flange on the exhaust pipe. The outlet flange 92 also is provided with an outlet port 96 and a pair of mounting apertures 98 and 100. The outlet port is telescopingly engaged over end 90 of the outlet tube 18 and is affixed there by weld 102 as shown most clearly in FIGS. 3 and 4. In certain embodiments the outlet tube 18 also is provided with one or more additional ports intermediate its opposed ends 86 and 90 for air pollution control equipment or heat recuperation members.

The subject hybrid exhaust manifold 10 typically is welded into its assembled form prior to mounting on the vehicle. The inlet flange 12 of the hybrid exhaust manifold 10 then is mounted against the engine cylinder head and is secured there by bolts extending through the mounting apertures 20 through 28. The bolt extending through the mounting aperture 28 on the inlet flange 12 also extends through apertures 58 and 83 on the inner and outer shells 14 and 16 respectively. The exhaust pipe of the vehicle then is mechanically connected to the outlet tube 18. Typically the exhaust pipe will include a mounting flange to cooperate with the outlet flange 92. In use exhaust gases generated by the respective cylinders of the engine are directed through the exhaust ports 30 through 34 of the inlet flange 12 and into the exhaust chamber 74 defined by the inner and outer shells 14 and 16. Specifically the exhaust gases enter the exhaust chamber 74 through the inlet apertures 44, 46 and 48. The exhaust gases then flow through the exhaust chamber 74 and exit into the outlet tube 18 through the outlet aperture 75.

In summary a hybrid exhaust manifold is provided which can be inexpensively manufactured and assembled to fit into a very small space envelope. The subject hybrid exhaust manifold includes an inlet flange formed from a metal plate which is adapted to be mounted on the engine cylinder head. The inlet flange includes a plurality of exhaust ports which are disposed to be aligned with the exhaust ports of the engine. Stamped sheet metal inner and outer shells are provided to mate with one another to define a generally enclosed exhaust chamber. The exhaust chamber defined by the combined inner and outer shells includes a plurality of inlet apertures which are formed in the inner shell to be aligned with the exhaust ports of the inlet flange. Preferably the inlet apertures include mounting flanges which telescopingly engage the walls of the exhaust ports. In assembly, the inner and outer shells are welded together along a seam which extends in a single plane around the periphery of the subject hybrid exhaust manifold. The exhaust chamber formed by the inner and outer shells further includes an outlet aperture to which an outlet tube is affixed. The outlet tube is bent into an appropriate configuration for mating with other components of the exhaust system. An outlet flange may be affixed to the end of the outlet pipe most distant from the outer shell to facilitate the connection of the hybrid exhaust manifold to the exhaust pipe. The size and shape of the various components of the hybrid exhaust manifold are selected in accordance with the dimensions of the engine and of the space envelope in the engine compartment.

While the preferred embodiment of the subject hybrid exhaust manifold has been described and illustrated, it is obvious that various changes and modifications can be made therein without departing from the spirit of the present invention which should be limited only by the scope of the appended claims.

What is claimed is:

1. A hybrid exhaust manifold for an engine having a plurality of cylinders which are operative to generate exhaust gases, said manifold comprising:

a generally planar inlet flange adapted to be mounted on the engine and having at least one exhaust port extending therethrough, said exhaust port being generally in register with at least one of said cylinders when said inlet flange is mounted on the engine;

a stamp formed sheet metal inner shell including at least one planar portion, said planar portion of said inner shell being mounted adjacent to said planar inlet flange, said inner shell further including an inlet aperture for each said exhaust port, said inlet aperture extending through the planar portion of said inner shell and being substantially the same size and configuration as the corresponding exhaust port, said inlet aperture being defined by a stamp formed mounting flange unitary with the inner shell and extending generally normal to the planar portion thereof, the mounting flange extending into and telescopingly engaging the corresponding exhaust port;

a stamp formed sheet metal outer shell fixedly attached to said inner shell, said inner and outer shells being configured to define an exhaust chamber therebetween, said outer shell including an outlet aperture extending therethrough; and an outlet tube fixedly attached to said outer shell adjacent said outlet aperture, whereby when said inlet flange is mounted on the engine, exhaust gases generated by the cylinders enter the exhaust chamber through the inlet aperture and exit the exhaust chamber through the outlet aperture and outlet tube.

2. A hybrid exhaust manifold as in claim 1 wherein the mounting flange of the inner shell is welded to said inlet flange.

3. A hybrid exhaust manifold as in claim 1 wherein said inner shell includes a peripheral flange extending continuously around and generally normal to the plane of said inner shell and away from said inlet flange, said peripheral flange being substantially adjacent and fixedly attached to said outer shell.

4. A hybrid exhaust manifold as in claim 3 wherein said peripheral flange is unitary with said inner shell.

5. A hybrid exhaust manifold as in claim 3 wherein said outer shell is fixedly attached to said inner shell by a continuous seam weld which lies in the plane of the inner shell.

6. A hybrid exhaust manifold as in claim 1 wherein said outer shell includes a peripheral flange extending generally parallel to the plane of the inner shell, said outer shell being fixedly attached to said inner shell by a continuous seam weld extending along the peripheral flange of the outer shell.

7. A hybrid exhaust manifold as in claim 1 wherein said outlet aperture is defined by a tube mounting flange, said tube mounting flange being in telescoping engagement with the outlet tube.

8. A hybrid exhaust manifold as in claim 1 wherein said inlet flange is formed from a metal plate.

9. A hybrid exhaust manifold as in claim 8 wherein the exhaust port of said inlet flange is defined by a chamfered edge disposed adjacent the mounting flange of the inner shell.

10. A hybrid exhaust manifold as in claim 9 wherein the chamfered edge defines an angle of approximately 45° with the plane of the inlet flange.

11. A hybrid exhaust manifold as in claim 1 further including an outlet flange fixedly attached to the outlet tube at the end thereof most distant from the outlet shell.

12. A hybrid exhaust manifold for an engine having a plurality of cylinders which are operative to generate exhaust gases, said manifold comprising:

a generally planar inlet flange formed from a metal plate and including a plurality of mounting apertures for mounting the inlet flange on the engine, said inlet flange including a plurality of exhaust ports extending therethrough, each said exhaust port being generally in register with at least one of said cylinders when said inlet flange is mounted on the engine;

a generally planar stamped formed sheet metal inner shell including an inlet aperture for each said exhaust port, each said inlet aperture being substantially the same size and configuration as the corresponding exhaust port, said inner shell being fixedly attached to said inlet flange such that each said inlet aperture is adjacent and in register with the corresponding exhaust port, each said inlet aperture being defined by a mounting flange stamp formed in said inner shell and extending generally normal to the plane of said inner shell to telescopingly engage the inlet flange at the corresponding exhaust port;

a stamp formed sheet metal outer shell fixedly attached to said inner shell by a seam weld lying substantially in the plane of the inner shell, said inner and outer shells being configured to define an exhaust chamber therebetween, said outer shell including an outlet aperture extending therethrough and being defined by a tube mounting flange; and an outlet tube telescopingly engaging and fixedly attached to the tube mounting flange of said outer shell, whereby when said inlet flange is mounted on the engine, exhaust gases generated by the cylinders enter the exhaust chamber through said inlet apertures and exit the exhaust chamber through the outlet aperture and outlet tube.

13. A hybrid exhaust manifold for an engine having a plurality of cylinders which are operative to generate exhaust gases, said manifold comprising:

a generally planar inlet flange adapted to be mounted on the engine and having at least one exhaust port extending therethrough, said exhaust port being generally in register with at least one of said cylinders when said inlet flange is mounted on the engine;

a stamp formed sheet metal inner shell including an inlet aperture for each said exhaust port, said inlet aperture being substantially the same size and configuration as the corresponding exhaust port, said inner shell being fixedly attached to said inlet flange such that said inlet aperture is in register with and adjacent the corresponding exhaust port;

a stamp formed sheet metal outer shell fixedly attached to said inner shell, said inner and outer shells being configured to define an exhaust chamber therebetween, said outer shell including an outlet aperture extending therethrough and a plurality of stamp formed stiffening ribs to minimize vibrations caused by operation of the engine; and an outlet tube fixedly attached to said outer shell adjacent said outlet aperture, whereby when said inlet flange is mounted on the engine, exhaust gases generated by the cylinders enter the exhaust chamber through the inlet aperture and exit the exhaust chamber through the outlet aperture and outlet tube.

14. A method for manufacturing a hybrid exhaust manifold for an engine having a plurality of cylinders which are operative to generate exhaust gases, said method comprising:

providing a planar metallic inlet flange, first and second sheets of metal and an outlet tube;

forming at least one exhaust port extending through the inlet flange, said exhaust port being positioned to be placed in registration with at least one of said cylinders;

stamp forming the first sheet of metal to define an inner shell having an inlet aperture for each said exhaust port and having a mounting flange substantially surrounding said inlet aperture;

stamp forming the second sheet of metal to define an outer shell having an outlet aperture extending therethrough, the stamp forming of said first and second sheets of metal being such that said inner and outer shells are matable to define an exhaust chamber therebetween;

mounting the inner shell to the inlet flange with each said mounting flange telescopingly engaging the corresponding exhaust port;

welding each said mounting flange to said inlet flange at the corresponding exhaust port;

welding said outer shell to said inner shell to form the exhaust chamber therebetween; and welding the outlet tube to the outer shell adjacent the outlet aperture therein.

* * * * *